US006265827B1

(12) United States Patent
Takahashi et al.

(10) Patent No.: US 6,265,827 B1
(45) Date of Patent: Jul. 24, 2001

(54) MERCURY-FREE METAL HALIDE LAMP

(75) Inventors: Kiyoshi Takahashi, Neyagawa; Makoto Horiuchi, Sakurai; Mamoru Takeda, Soraku-gun; Takeshi Saito, Amagasaki; Hideaki Kiryu, Takatsuki, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/381,140

(22) PCT Filed: Feb. 17, 1999

(86) PCT No.: PCT/JP99/00713

§ 371 Date: Sep. 16, 1999

§ 102(e) Date: Sep. 16, 1999

(87) PCT Pub. No.: WO99/43020

PCT Pub. Date: Aug. 26, 1999

(30) Foreign Application Priority Data

Feb. 20, 1998 (JP) ..... 10-038417
Sep. 16, 1998 (JP) ..... 10-261153
Sep. 18, 1998 (JP) ..... 10-264649

(51) Int. Cl.[7] ..... H01J 61/20
(52) U.S. Cl. ..... 313/638; 313/570; 313/643
(58) Field of Search ..... 313/643, 637, 313/638, 570

(56) References Cited

U.S. PATENT DOCUMENTS

| | | | | |
|---|---|---|---|---|
| 4,634,927 | | 1/1987 | Mori et al. . | |
| 4,709,184 | | 11/1987 | Keeffe et al. . | |
| 5,057,743 | | 10/1991 | Krasko et al. . | |
| 5,363,007 | | 11/1994 | Fromm et al. . | |
| 5,965,984 | * | 10/1999 | Horiuchi et al. | 313/638 X |
| 5,973,454 | * | 10/1999 | Ooyama et al. | 313/643 X |
| 6,005,346 | * | 12/1999 | Shaffner | 313/643 X |

FOREIGN PATENT DOCUMENTS

| | | |
|---|---|---|
| 55-4857 | 1/1980 | (JP) . |
| 56-126244 | 10/1981 | (JP) . |
| 3-101044 | 4/1991 | (JP) . |
| 5-129004 | 5/1993 | (JP) . |
| 9-306426 | 11/1997 | (JP) . |
| 10-144259 | 5/1998 | (JP) . |

* cited by examiner

*Primary Examiner*—Ashok Patel
(74) *Attorney, Agent, or Firm*—Parkhurst & Wendell, L.L.P

(57) ABSTRACT

The present invention provides a mercury-free metal halide lamp with an increased lamp operating voltage and prolonged lamp life without enclosing mercury or excessively increasing an inner pressure of an arc tube. A lamp in accordance with the present invention contains, as a content of a fill material 202, 0.04 mg of $ScI_3$, 0.21 mg of NaI, 7 atm of Xe at room temperature, and 0.1 mg of $YI_3$, which is an iodide of Y, Y having an ionization potential as a simple substance being 5 to 10 eV and a vapor pressure at a temperature of lamp operation being $10^{-5}$ or higher.

22 Claims, 13 Drawing Sheets

MERCURY-FREE METAL HALIDE LAMP

TECHNICAL FIELD

This invention relates to a mercury-free metal halide lamp usable for general luminaries, and motor vehicle headlights constructed with reflectors and the like.

BACKGROUND ART

Conventionally, metal halide lamps have been employed for such uses as a light source for motor vehicle headlights and so forth. Conventional metal halide lamps typically have such a construction in which three types of materials, rare gas (gaseous matter), mercury (liquid matter), and halide of metal (solid matter), are enclosed in an arc tube. More specifically, an example of such lamps is as follows:

As shown in FIG. 12, an approximately spherical-shaped arc tube 101 encloses a fill material 102. The arc tube 101 is composed of a light-transmissive vessel made of quartz. Each of the ends of the arc tube 101 is sealed at a seal portion 103. A pair of tungsten electrodes 104 is provided in the arc tube 101. Each of the electrodes 104 is connected with a lead wire 106 via a molybdenum foil 105 hermetically sealed in the seal portion 103. The dimensions of this metal halide lamp are as follows:

Arc tube internal volume: 1.7 cc

Distance between the electrodes 104: approx. 16 mm

The contents in the fill material 107 are as follows:

Hg (mercury): 21.5 mg (12.6 mg/cc)

TlI (thallium iodide): 0.27 mg (0.16 mg/cc)

InI (indium iodide): 0.04 mg (0.021 mg/cc)

NaI (sodium iodide): 1.9 mg (1.14 mg/cc)

Xe (xenon): 12 kPa (at room temperature)

When the lamp according to the above construction is operated under the condition where the electric current is controlled in order for the lamp power to be maintained at 100 W, a luminous flux of approximately 6200 lm is emitted by the electric discharge between the electrodes 104. In this operation, all of the mercury and a portion of the metal halides such as TlI etc. are evaporated, and a voltage (operating voltage) drop of 100 V is caused between the foremost ends of the electrodes 104.

The above-mentioned rare gas (Xe) is enclosed in order to facilitate a starting (start of discharge) and to increase the light output immediately after the starting. The metal halides (such as TlI) are enclosed in order to obtain an appropriate light output during a stable operation.

Mercury is enclosed in order to obtain a high voltage between the electrodes (operating voltage), which is required for the stable operation of the lamp. A voltage increasing effect of mercury is, more specifically, represented by the following equation as disclosed in, for example, Japanese Unexamined Patent Publication No. 06-13047 etc.

$$Vla=20+k\ (\text{proportional constant})\times n\mathrm{Hg}^{0.56}\times L,$$

In the equation, Vla is an operating voltage (V), nHg is an amount of mercury per unit arc tube internal volume (mg/cc), and L is a distance between electrodes (mm).

From the equation, it is understood that the operating voltage is proportional to the product of the distance between electrodes and the approximately ½ power of an atomic density of mercury. In the above equation, the constant '20' is the sum of the voltage approximately at the electrodes and a voltage by the effects of the rare gas and metal halides. According to this equation, if mercury is not added, the operating voltage is greatly dropped (nHg=0, and thereby the operating voltage is approximately 20 V.). Therefore, the electric current is required to be increased in order to operate the lamp with the same power (in comparison with the case of the operating voltage being approximately 100 V, the required current is approximately SA, which is 5 times as large.). Hence, electrode losses are increased, and a conspicuous blackening of the arc tube is caused by a sputtered matter of the electrodes, thus deteriorating the luminous flux. Specifically, the arc tube is blackened in as short as several tens of hours and reaches the end of its lamp life.

In view of the above problem, in conventional lamps, the operating voltage is increased to be approximately 70 to 100 V by adjusting the amount of mercury, and thereby the lamp current is suppressed and the electrode losses (Joule loss) are also reduced. A long lamp life up to several thousand hours (for example, approximately 6000 hours) is thus achieved However, while mercury brings about such a desirable effect that the operating voltage can be increased as above, it incurs such drawbacks as follows.

Firstly, since mercury causes a deterioration of luminous efficacy, attaining a bright lamp becomes difficult. That is because mercury has the second highest excitation potential in all the elements, next to rare gases, and therefore the light emission is little when compared with other metallic elements employed as metal halides. This fact is also seen from the spectral distribution of the above-described metal halide lamp, as shown in FIG. 13. Specifically, the emitted light of the lamp retains a plurality of line spectra, and the major wavelengths are 410.01 nm and 451.1 nm by In, 535.0 nm by Ti, and 589.0 nm and 589.6 nm by Na. Since mercury contributes little to the light emission, very little light emission by mercury is observed. On the other hand, in the case where no mercury is added in the above lamp, a high luminous efficacy of approximately 70 lm/W (the whole luminous flux is approximately 7000 lm) is obtained.

Secondly, a step of enclosing mercury, being a liquid matter, is necessary in the manufacturing steps of such a lamp, which tends to increase the manufacturing cost.

In addition to the above drawbacks, in recent years, metal halide lamps containing no mercury have been increasingly desired since a global environmental concern has been growing.

In view of these problems and perspectives, in order to raise an operating voltage without adding mercury, Japanese Unexamined Patent Publication No. 06-84496 etc. discloses an example of a technique in which the fill pressure of Xe is increased. More specifically, according to the description, in a metal halide lamp in which only a rare gas and metal iodides such as $ScI_3$ and NaI are enclosed in the arc tube and no mercury is contained, an operating voltage of 50 V or higher can be achieved by satisfying the equation, $$P\times L\geqq 40,$$

where the distance between electrodes in the lamp is L (mm), and in the case of the rare gas to be enclosed being Xe, the fill pressure of Xe at room temperature is P (atm).

In accordance with the above teachings, the present applicants prepared a lamp that has the same shape as the one illustrated in the aforementioned FIG. 12, with the major dimensions and the fill material being as follows, and the operating voltage of the lamp was measured using the lamp thus prepared.

Arc tube internal volume: 0.025 cc

Distance between electrodes: approx. 4 mm

The fill material 107 contained the following.

$ScI_3$ (scandium iodide): 0.04 mg

NaI (sodium iodide): 0.21 mg (The total weight of $ScI_3$ and NaI is 0.25 mg)

Xe (xenon): 10 atm (at room temperature)

In this lamp, P×L becomes 40, and therefore this lamp satisfies the condition of the above-described lamp. However, when this lamp was operated with a lamp power of 35 W, the operating voltage resulted in 35 V, falling short of 50 V described in the publication. As a result, electrode sputtering was caused by the large lamp current, which led to blackening of the arc tube wall by the sputtered electrode material attached to the arc tube inner wall, and consequently the emitted luminous flux was reduced in an early stage. It is considered from the above result, that, in order to obtain an operating voltage of 50 V or higher, the minimum Xe pressure (10 atm) which satisfies the condition of $P \times L \geqq 40$ is insufficient, and according to the assumption made by the present inventors, it is necessary that the Xe pressure be controlled at a pressure of approximately 25 atm, which is far higher than 10 atm as set forth in the description.

However, controlling the fill pressure of Xe at such a high level incurs other drawbacks as described in the following.

Firstly, Xe shows a high ionization potential of approximately 12 eV, and therefore, in order to cause a discharge when the starting of the lamp at a pressure of over 25 atm, a considerably high starting voltage should be applied. More specifically, a lamp in which Xe is enclosed with a pressure of approximately 7 to 10 atm, a starting voltage required to ensure the start of discharge is 30 kV or above. On the other hand, in the case where the fill pressure is over 25 atm, a far higher starting voltage is required. Consequently, a complicated and large-scale starting circuit for generating the starting voltage becomes necessary, which incurs such disadvantages as an increase of the manufacturing cost and the like.

In addition, Xe has a relatively high excitation potential, and therefore, when Xe is enclosed with a high pressure, a decrease of luminous efficacy is induced.

Furthermore, in the case of the fill pressure being such a high pressure as above (note that this causes a further pressure increase in the arc tube in the lamp operation), there are increased possibilities of a burst of the arc tube and a leak of the fill material.

In summery, prior art metal halide lamps have such drawbacks that it is difficult to suppress the electric current by increasing the operating voltage of the lamp without adding mercury or making the inner pressure of the arc tube excessively high, and thereby to prolong the lamp life.

In addition, the prior art metal halide lamps that contain no mercury also have such a drawback that, since no light emission by mercury is obtained, the chromaticity deviation of the chromaticity coordinate of the emitted light by the lamps from a blackbody locus in a CIE 1960 u,v chromaticity diagram results in 0.011, and therefore, in cases of the uses for white light motor vehicle headlights, the lamps do not meet the standard of Gas Discharge Light Sources for Motor Vehicles Headlamps provided by the Japan Electrical Lamp Manufacturers Association (JEL 215).

DISCLOSURE OF THE INVENTION

In view of the problems of the prior arts, it is an object of the present invention to provide a mercury-free metal halide lamp with an increased lamp operating voltage and prolonged lamp life without adding mercury or excessively increasing an inner pressure of an arc tube.

This and other objects are accomplished in accordance with the present invention by providing a mercury-free metal halide lamp comprising in an arc tube at least:

a rare gas, at least one of Sc (scandium) and halide of Sc, at least one of Na (sodium) and halide of Na, and at least one of metal and halide of the metal, the metal having an ionization potential as a simple substance of 5 to 10 eV, and the metal or halide of the metal having a vapor pressure of at least $10^{-5}$ atm at an operating temperature of the lamp.

By enclosing such metal or the halide of the metal as set forth above, it is made possible to increase an operating voltage of the lamp and reduce an electric current to be applied to the lamp without enclosing a rare gas with a high pressure. As a result of this, electrode losses are reduced and therefore a blackening of the arc tube caused by sputtering of the electrode material is suppressed A prolonged lamp life is thus achieved.

It is noted that the operating voltage is reduced in the case where a material to be added does not meet the above conditions, i.e., a material that has an ionization potential as a simple substance of lower than 5 eV, for example CsI (cesium iodide: ionization potential being 3.9 eV). This is due to the fact that such materials have a low ionization potential and therefore a large amount of electron is supplied to the arc, resulting in an increase of the operating current and accordingly a drop of the operating voltage. On the other hand, in the case where the material to be added has an ionization potential as a simple substance of higher than 10 eV, as seen in Hg (mercury), an efficiency of the lamp is reduced. In addition, in the case where the material to be added has a vapor pressure of higher than $10^{-5}$ atm at an operating temperature of the lamp, no effect of increasing the operating voltage is obtained In addition, a mercury-free metal halide lamp according to the above construction may be such a lamp in which the amount of Sc or halide of Sc, the amount of Na or halide of Na, the amount of the metal or halide of the metal, and a rated power of the lamp are determined so that, in a CIE1931 x,y chromaticity diagram, a chromaticity coordinate of an emitted light of the lamp satisfies the following equations:

$$x \geqq 0.310,$$

$$x \leqq 0.500,$$

$$y \leqq 0.150+0.640x,$$

$$y \leqq 0.440,$$

$$y \geqq 0.050+0.750x,$$

and $$y \geqq 0.382 \text{ (in the case where } x \geqq 0.44).$$

More specifically, for example, $YI_3$ whose amount is within the range of 0.8 mg/cc to 12 mg/cc per unit internal volume of the arc tube may be added as the above-mentioned halide of metal, and a rated power of the lamp may be set to be within the range of 25 W to 55 W.

In addition, a lamp according to the above construction may be such a lamp in which the amounts of the contents of the fill material and a rated power of the lamp are determined so that, in a CIE1931 x,y chromaticity diagram, a chromaticity deviation of a chromaticity coordinate from a blackbody locus is within the range of −0.025 to 0.01.

More specifically, for example, a lamp according to the above construction may be such a lamp in which:

the halide of Sc is $ScI_3$, the halide of Na is NaI, and the amount of Sc or halide of Sc, the amount of Na or halide of Na, the amount of the metal or halide of the metal, and a rated power of the lamp are determined so that the following equation is satisfied:

$$-0.025 \leqq D = -0.066 + 0.05A + 0.008B + 0.007A^2 - 0.0009AB - 0.0003B^2 \leqq 0.01$$

where A=the weight of $ScI_3$/(the weight of $ScI_3$+the weight of NaI) and B=rated power/distance between electrodes (W/mm).

According to the above construction, it is made possible to produce a lamp capable of emitting a light with a high quality of white color, and the lamp produced in accordance with this construction can be applied to, for example, such uses as a lamp for motor vehicle headlights.

In addition, a lamp according to the above construction may be such a lamp in which the amount of Sc or halide of Sc, the amount of Na or halide of Na, the amount of the metal or halide of the metal, and a rated power of the lamp are determined so that a luminous flux of an emitted light of the lamp results in at least approximately 1100 lm, or more preferably at least approximately 2750 lm.

More specifically, for example, a lamp according to the above construction may be such a lamp in which:

the halide of Sc is ScI3, the halide of Na is NaI, and the amount of Sc or halide of Sc, the amount of Na or halide of Na, the amount of the metal or halide of the metal, and a rated power of the lamp are determined so that the following equation is satisfied:

$$1100 \leqq -4054 + 2759A + 182C - 1628A^2 + 18\,AC - 0.7C^2$$

where A=the weight of $ScI_3$/(the weight of $ScI_3$+the weight of NaI) and C=lamp power (W).

According to the above construction, it is made possible to produce a lamp capable of emitting a light with a large luminous flux, and the lamp produced in accordance with this construction can be can be applied to, for example, such uses as a lamp for motor vehicle headlights.

Further, an object of the present invention can also be achieved by the provision of a mercury-free metal halide lamp comprising an arc tube which encloses at least:

a rare gas, at least one of In (indium) and halide of In, at least one of TI (thallium) and halide of TI, and at least one of Na (Sodium) and halide of Na, the lamp in which:

the amount of the In or halide of In is such an amount that an absorption spectrum is observed at approximately 410 nm and 451 nm in a spectral distribution, the amount of the Tl or halide of Tl is such an amount that an absorption spectrum is observed at approximately 535 nm in a spectral distribution, and the amount of the Na or halide of Na is such an amount that an absorption spectrum is observed at approximately 589 nm in a spectral distribution.

In brief, the present inventors have unexpectedly found that a lamp operating voltage can be greatly increased by adding such a large amount of In or halide of In, Tl or halide of Tl, and Na or halide of Na, which was not expected from well-known enclosing amounts. Again, according to this construction, it is made possible to increase an operating voltage of the lamp and reduce an electric current to be applied to the lamp without a rare gas being filled at a high pressure. As a result of this, electrode losses are reduced and therefore a blackening of the arc tube caused by sputtering of the electrode material is suppressed, and thereby a prolonged lamp life is achieved.

More specifically, as for an example of the above amounts of the fill material contents, the amount of the In or halide of In may be within the range of 4 to 12 mg/cc per unit internal volume of the arc tube, the amount of the Tl or halide of Tl may be within the range of 4 to 16 mg/cc per unit internal volume of the arc tube, and the amount of the Na or halide of Na may be within the range of 4 to 12 mg/cc per unit internal volume of the arc tube.

In addition to the above construction, a mercury-free metal halide lamp according to the present invention may be such a lamp in which the amount of In or halide of In, the amount of Tl or halide of Tl, the amount of Na or halide of Na, and a rated power of the lamp are determined so that, in a CIE1931 x,y chromaticity diagram, a chromaticity coordinate of an emitted light of the lamp satisfies the following equations:

$$x \geqq 0.310,$$

$$x \leqq 0.500,$$

$$y \leqq 0.150 + 0.640x,$$

$$y \leqq 0.440,$$

$$y \geqq 0.050 + 0.750x,$$

and $$y \geqq 0.382 \text{ (in the case where } x \geqq 0.44).$$

According to the above construction, it is made possible to produce a lamp capable of emitting a light with a high quality of white color, and the lamp produced in accordance with this construction can be applied to, for example, such uses as a lamp for motor vehicle headlights.

In the above construction, a rated power of the lamp may be in the range of 25 W to 55 W.

According to the above construction, it is made possible to produce a lamp capable of emitting a light with a large luminous flux, and the lamp produced in accordance with this construction can be can be applied to, for example, such uses as a lamp for motor vehicle headlights.

Also in the above construction, the rare gas may comprise at least Xe (xenon), and an enclosed pressure of the Xe may be in the range of 1 atm to 25 atm at room temperature By filling Xe with such a pressure, it is made possible to produce a mercury-free metal halide lamp that has little possibility of a burst of the arc tube and a leak of the fill material and has such a low operating voltage as above.

BRIEF DESCRIPTION OF THE DRAWINGS

For a more complete understanding of the present invention, and the advantages thereof, reference is now made to the following descriptions taken in conjunction with the accompanying drawings, in which.

BEST MODE FOR CARRYING OUT THE INVENTION

Embodiment 1

Figure 1:
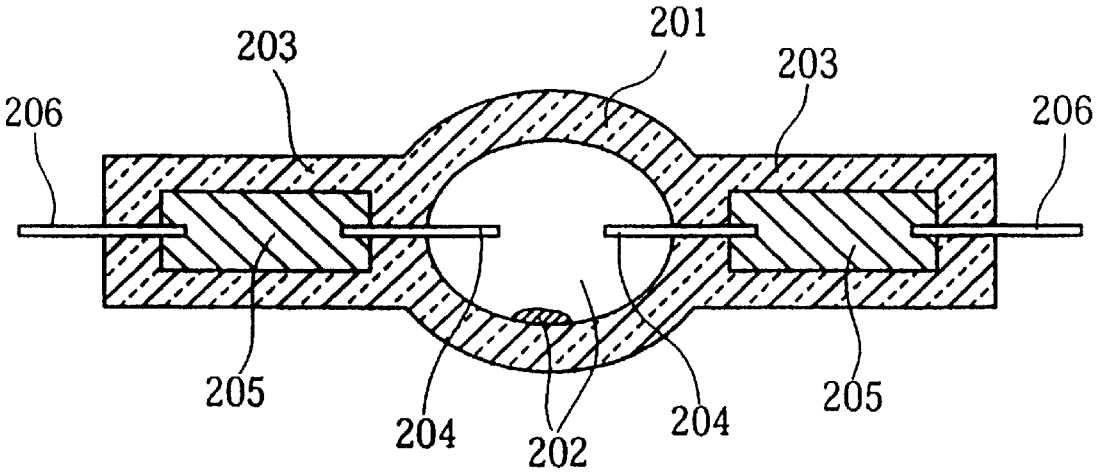
FIG. 1 is a cross-sectional view showing a construction of a mercury-free metal halide lamp according to Embodiments 1 to 4.

As shown in FIG. 1, a mercury-free metal halide lamp according to Embodiment 1 has an arc tube 201 having an approximately spherical shape, and a fill material 202 is enclosed in the arc tube 201. The arc tube 201 is composed of a light-transmissive vessel made of quartz, and each end of the arc tube 201 is sealed at a seal portion 203. In the arc tube 201, there are provided a pair of tungsten electrodes 204. Each of the electrodes 204 is connected with an external lead wire 206 via a molybdenum foil 205, which is hermetically sealed in the seal portion 203. The dimensions of this lamp are as follows:

Internal volume of the arc tube: approx. 0.025 cc

Distance between electrodes: approx. 4 mm

The contents of the fill material 202 are as follows:

$ScI_3$ (scandium iodide): approx. 0.04 mg

NaI (sodium iodide): approx. 0.21 mg (The total sum of $ScI_3$ and NaI is approx. 0.25 mg, and $ScI_3/(ScI_3+NaI)$=approx. 0.16)

$YI_3$ (yttrium iodide): approx. 0.1 mg

Xe (xenon): approx. 700 kPa (at room temperature)

In the above contents, xenon functions as a starting gas. The Y (yttrium), which is contained in $YI_3$, has an ionization potential as a simple substance of 6.4 eV.

The voltage (operating voltage) at both ends of the lamp according to the above construction was 35 V, when the lamp was disposed horizontally and an electric current was applied to the lamp, the current being controlled so that the lamp power became stable at 45 W. On the other hand, in the case of the lamp that does not contain $YI_3$, the operating voltage was 28 V, and therefore the lamp of the Embodiment 1 achieved 7 V higher voltage. Thus, by increasing the operating voltage, a lamp current can be reduced if the lamp is operated at the same lamp power. As a result, a heat load (heat losses) at the electrodes 204 is reduced, and an excessive temperature increase is thereby prevented. Consequently, a blackening of the arc tube 201 is suppressed, which leads to an improved luminous flux, and thus a lamp life is extended.

It is noted here that, in order to raise the operating voltage as described above without containing mercury in the fill material 202, the content of the fill material is not limited to $YI_3$, and may be a content containing a metal having an ionization potential as a simple substance of 5 to 10 eV, and a vapor pressure of at least $10^{-5}$ at an operating temperature of the lamp. Note that the ionization potential as a simple substance of Y is 6.4 eV, as mentioned above. The vapor pressure in a lamp being operated can be obtained according to the following. For example, in the case of the above-described lamp, the temperature of the coldest point in the exterior surface of the arc tube 201 when operated was approximately 700° C. at the lower portion of the arc tube 201. Taking into consideration the thermal conductivity of quartz, the temperature of the internal surface of the arc tube 201 is estimated to be approximately 800° C., and therefore the vapor pressure of $YI_3$ at this temperature is approximately $10^{-5}$ atm.

The luminous flux of the above-described lamp was 4700 lm. From this result, it is understood that the metal halide lamp according to Embodiment 1 achieves a sufficiently large luminous flux, in comparison with the luminous flux of a halogen lamp generally used for motor vehicle headlights, which is approximately 1100 lm. Therefore, the metal halide lamp of Embodiment 1 meets the requirement of the luminous flux for motor vehicle headlights.

The description now details color characteristics of the lamp according to Embodiment 1.

Figure 2:
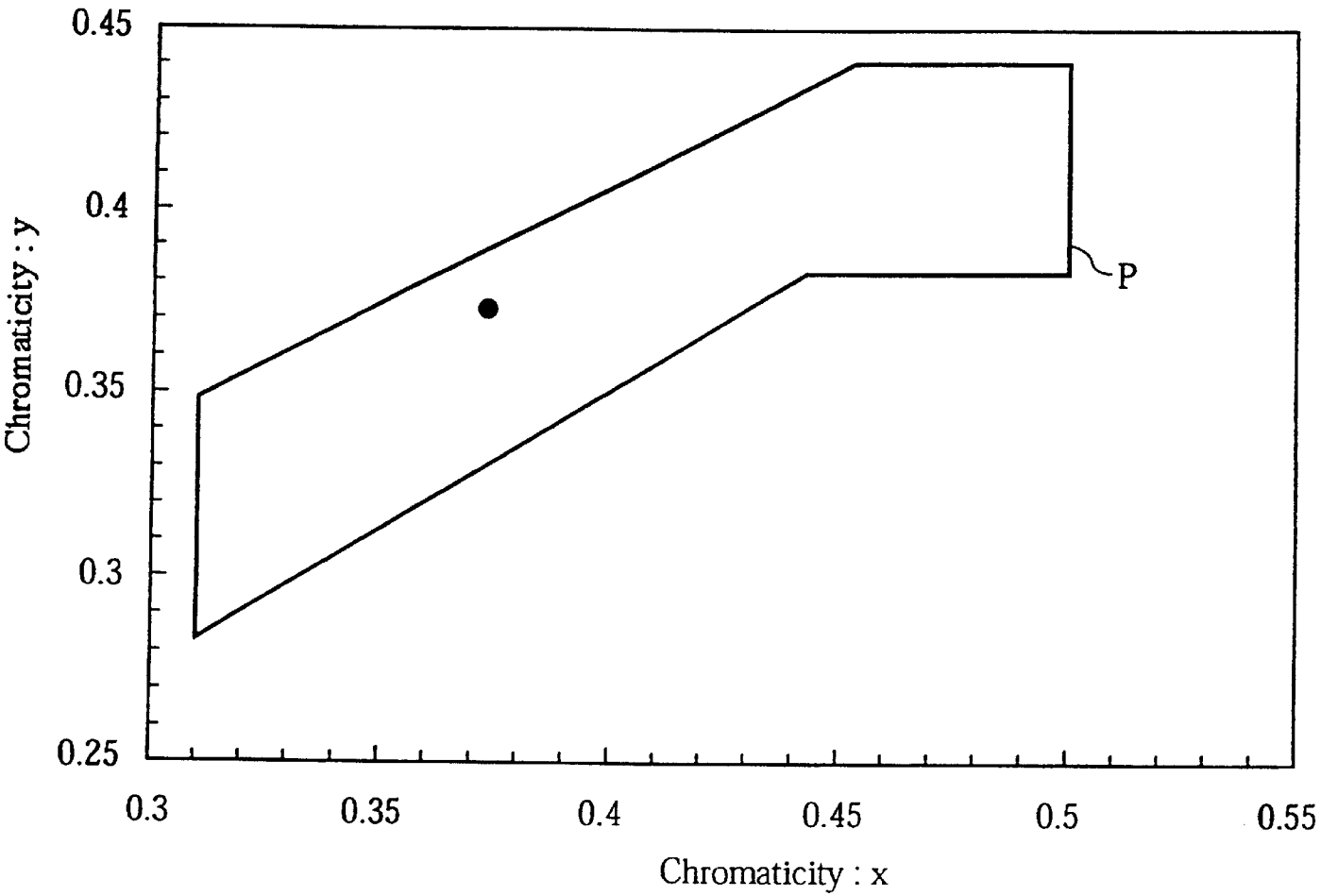
FIG. 2 is a diagram showing a chromaticity coordinate of an emitted light of a mercury-free metal halide lamp according to Embodiment 1.

FIG. 2 shows a chromaticity coordinate of the emitted light of the lamp made in accordance with this embodiment, the chromaticity coordinate being plotted in a CIE1931 x,y chromaticity diagram. The region P enclosed within the solid lines represents a chromaticity range of the standard specified in 'Gas-discharge Light Sources for Motor Vehicles Headlamps' by the Japan Electrical Lamp Manufacturers Association (JEL 215). The region is represented by the following equations.

$$x \geqq 0.310$$

$$x \leqq 0.500$$

$$y \leqq 0.150+0.640x$$

$$y \leqq 0.440$$

$$y \geqq 0.050+0.750x$$

$$y \geqq 0.382 \text{ (when } x>0.44)$$

From the above-mentioned FIG. 2, it is apparent that the lamp made in accordance with the Embodiment 1 meets the chromaticity required for a white light source for motor vehicle headlights.

Figure 3:
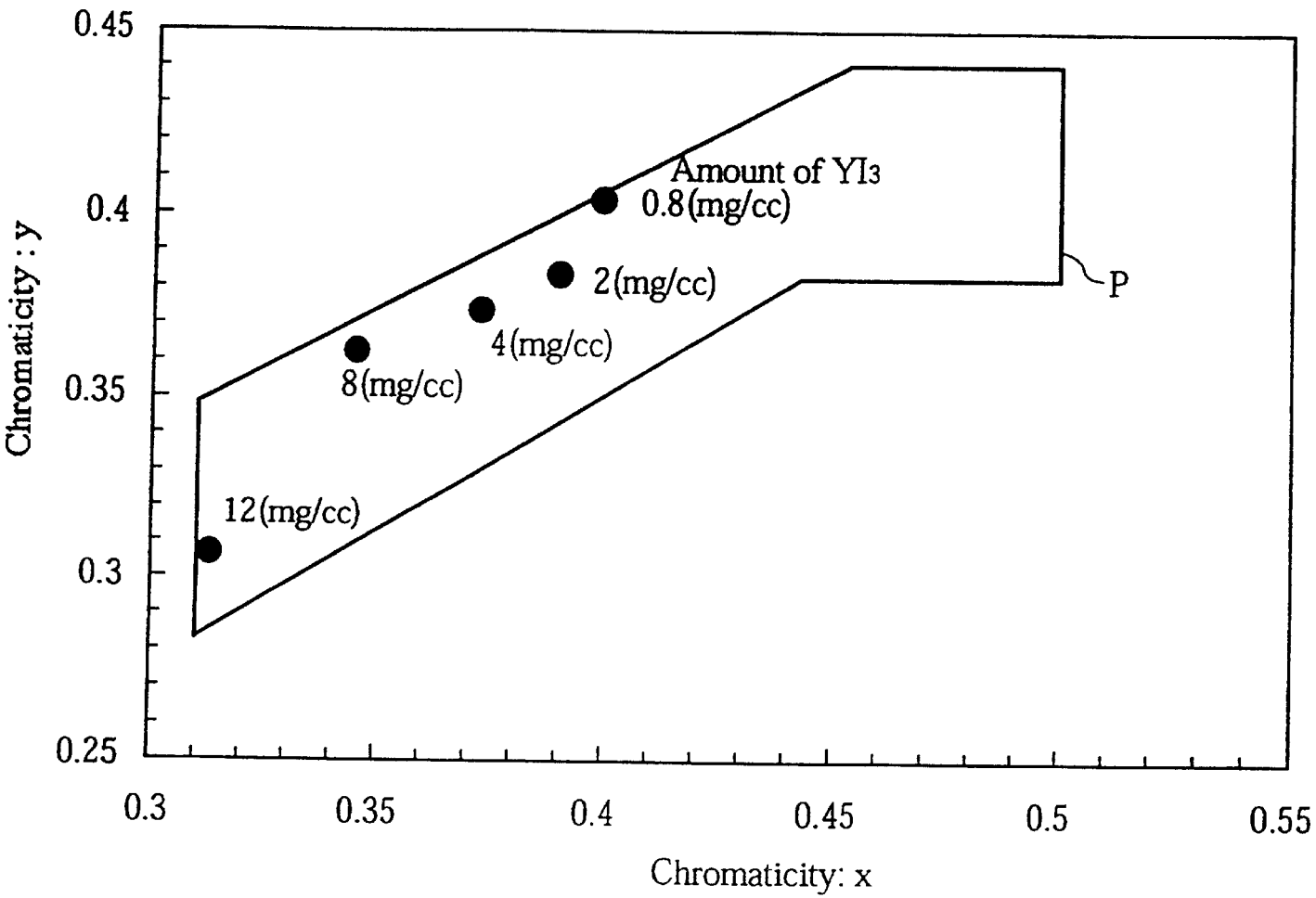
FIG. 3 is a diagram showing chromaticity coordinates of a mercury-free metal halide lamp according to Embodiment 1 in the cases of an enclosing amount of $YI_3$ being varied.

The above-mentioned chromaticity varies depending upon the added amount of $YI_3$ and the lamp power. With respect to this, using the lamps each made to have a different added amount of $YI_3$, the chromaticity of each lamp operated with a lamp power of 45 W was measured. These results are shown in FIG. 3, plotted as in FIG. 2. It is understood that, as the amount of $YI_3$ increases, the light emission by Y, which causes an abundant light emission in a blue region of spectrum, produces a larger effect, and the values x and y in chromaticity consequently become smaller. In consideration of this, it is to be understood as seen from FIG. 3 that the chromaticity according to the above-mentioned standard can be obtained when the added amount of $YI_3$ is in the range of 0.8 to 12 mg/cc (0.02 to 0.3 mg in the case of the internal volume of arc tube being 0.025 cc). As for the lamp power, the same chromaticity was obtained in the range of 25 to 55 W.

Embodiment 2

Now, there is described below an example of a mercury-free metal halide lamp in accordance with Embodiment 2, in which InI (indium iodide) is employed in place of $YI_3$ in the lamp in accordance with Embodiment 1. In this lamp, the fill material contains, as metal halides, approximately 0.04 mg of $ScI_3$, approximately 0.21 mg of NaI, and approximately 0.2 mg of InI. The other contents in the fill material and the shape of the lamp are identical to those of the lamp according to Embodiment 1.

The operating voltage was 55 V, when the lamp in accordance with this construction was operated in the same manner as in Embodiment 1, i.e., with a lamp power of 45 W. In the case of the lamp containing neither $YI_3$ nor InI, the operating voltage was 28 V, and therefore the lamp of the Embodiment 2 achieved 27 V higher operating voltage. This demonstrates that the lamp according to this embodiment is capable of achieving further prolonged lamp life in comparison with the lamp of Embodiment 1.

The luminous flux of the above-described lamp was approximately 3600 lm. From this result, it is understood that the lamp according to Embodiment 2 achieves a sufficiently large luminous flux, in comparison with the luminous flux of a halogen lamp generally used for motor vehicle headlights, which is approximately 1100 lm. Therefore, the lamp of Embodiment 2 also meets the requirement of the luminous flux usable for motor vehicle headlights.

It is noted that the ionization potential of I (indium) as a simple substance, which is contained in the aforementioned InI, is 5.8 eV. The temperature of the internal surface of the arc tube 201 is estimated to be approximately 800° C. according to the same manner as in Embodiment 1, and the vapor pressure of InI at this temperature is approximately 2 atm.

Figure 4:
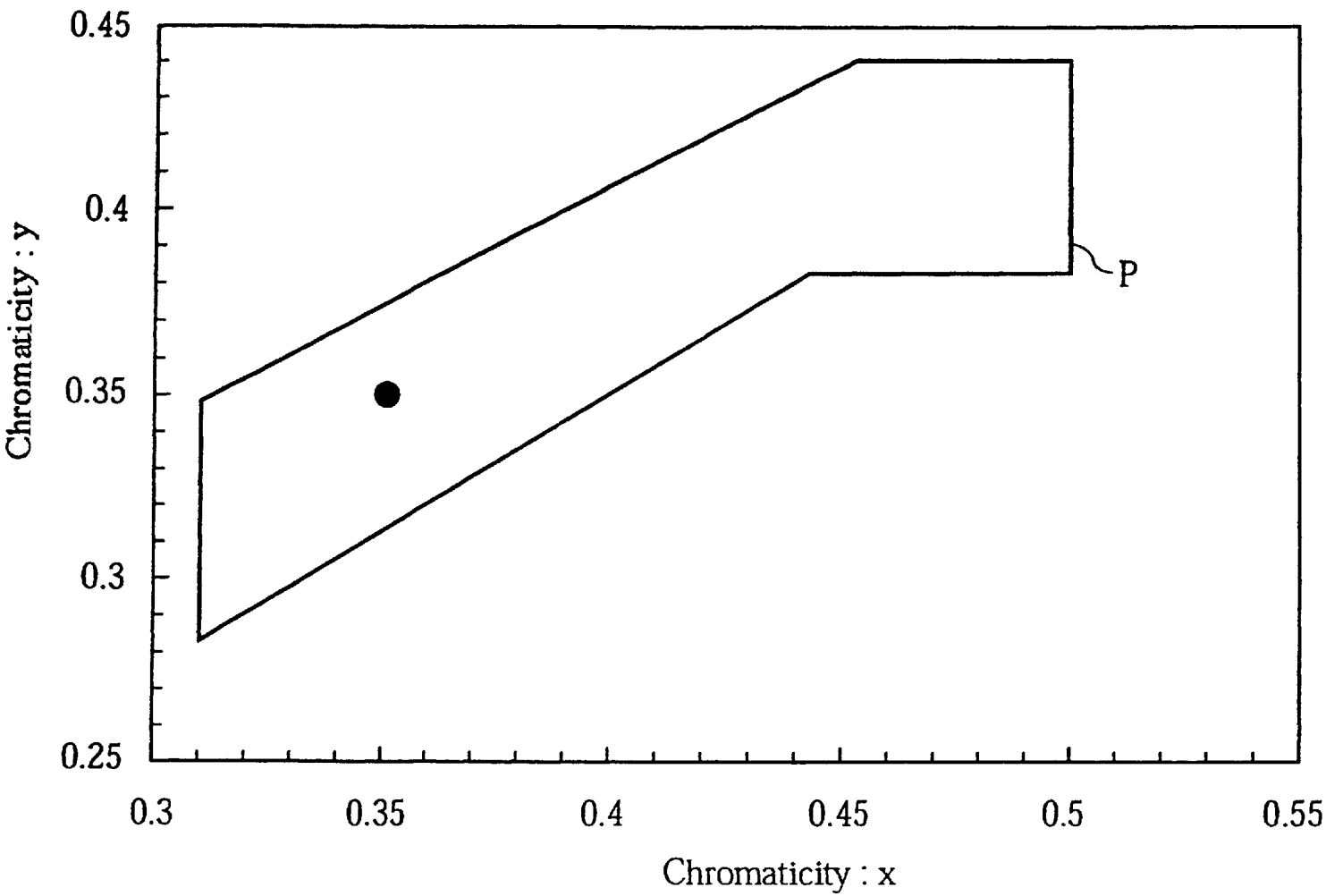
FIG. 4 is a diagram showing a chromaticity coordinate of an emitted light of a mercury-free metal halide lamp according to Embodiment 2.

FIG. 4 shows the chromaticity coordinate of the emitted light of the lamp according to this embodiment, plotted in a CIE1931 x,y chromaticity diagram. From this diagram, it is confirmed that the lamp according to Embodiment 2 also meets the chromaticity required for a white light source for motor vehicle headlights.

Embodiment 3

Now, the description details an example of a mercury-free metal halide lamp in accordance with Embodiment 3, in which a proportion of $ScI_3$ and NaI in the fill material is varied. More specifically, the fill material of this lamp contains, as metal halides, 0.4 mg of $YI_3$, and the total weight of 0.25 mg of $ScI_3$ and NaI (the total weight of the metal halides is 0.65 mg.). The weight ratio of the $ScI_3$ per the total weight of $ScI_3$ and NaI (hereinafter referred to as a '$ScI_3$ weight ratio'. Note that the larger the $ScI_3$ weight ratio value is, the larger the weight of $ScI_3$ contained in the fill material is.) is set at 0.016, 0.75, or 1 (no NaI contained). The other contents in the fill material and the shape of the lamp are identical to those of Embodiment 1.

The operating voltages of the above-described lamp when operated with a lamp power of 35 W are set forth in Table 1 below. In Table 1, the operating voltages of the lamp of Embodiment 1 and the lamp containing no $YI_3$, are also shown.

TABLE 1

| | | Weight of $ScI_3$ / Weight of $ScI_3$ + Weight of NaI | | |
|---|---|---|---|---|
| | | 0.16 | 0.75 | 1 |
| Operating voltage | $YI_3$: 0.4 (mg) (Embodiment 3) | 39 (V) | 44 (V) | 44 (V) |
| | $YI_3$: 0.1 (mg) (Embodiment 1) | 35 (V) | — | — |
| | $YI_3$: not contained (Control example) | 25–28 (V) | 36 (V) | 40 (V) |

Lamp power: 35 W

As apparent from the above Table 1, regardless of the $ScI_3$ weight ratio, the lamp according to Embodiment 3 can achieve higher operating voltages than the lamp that does not contain $YI_3$. It is noted that the same effect of increasing an operating voltage is obtained when the lamp power is other than 35 W, although the above Table 3 shows only the case of the lamp power being 35 W. It is noted, however, that the color characteristics and the luminous flux become different depending on the $ScI_3$ weight ratio and the lamp power. In consideration of this, now the description will explain the conditions that can provide a high quality of white color chromaticity and a large luminous flux.

First, the color characteristics of the above-described lamp are detailed.

Figure 5:
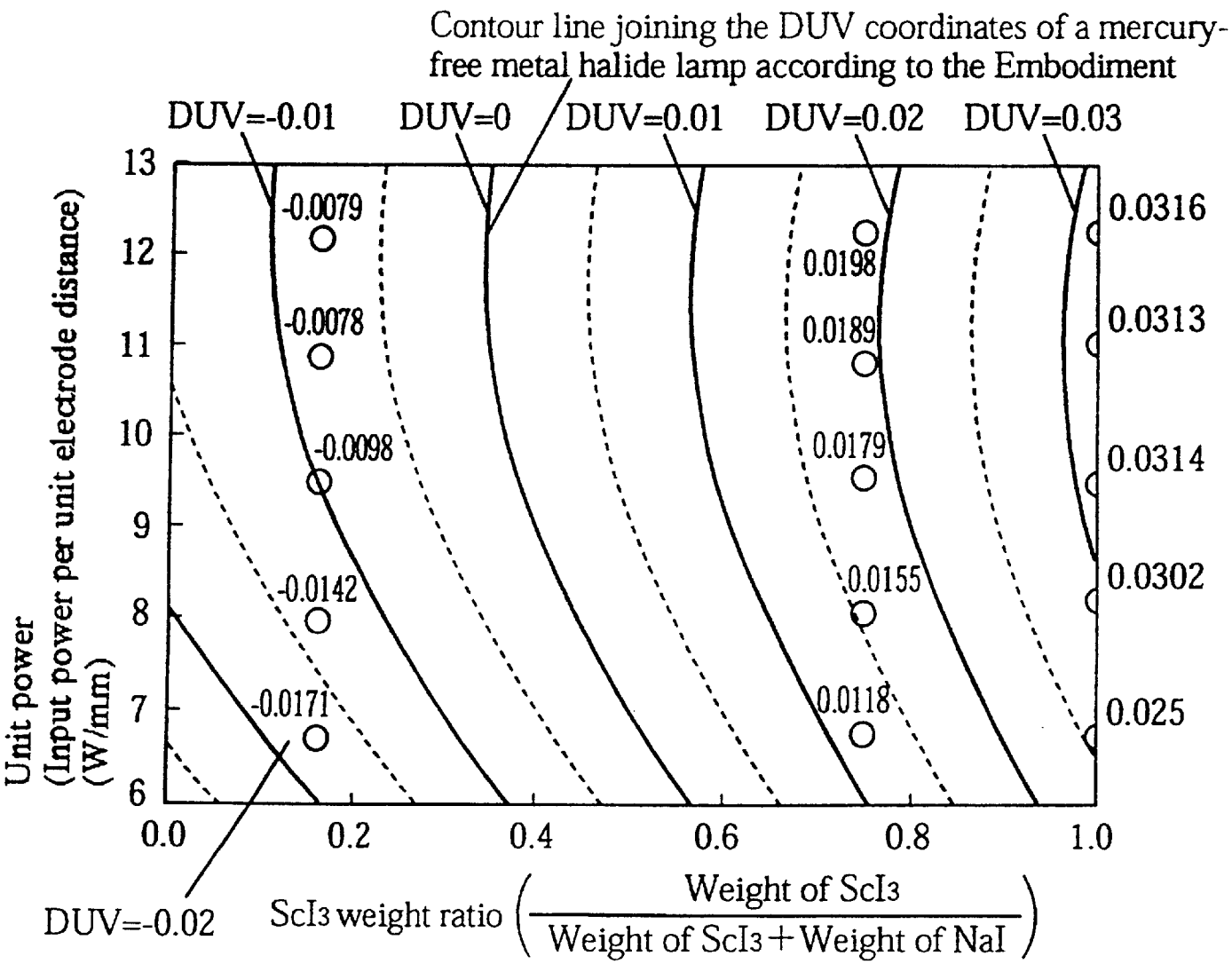
FIG. 5 is a diagram showing a relationship between a $ScI_3$ weight ratio and a unit power and a DUV of a mercury-free metal halide lamp according to Embodiment 3.

The lamps according to Embodiment 3, which are made to have various $ScI_3$ weight ratios, were operated with lamp powers of 20 W to 55 W, and concerning each of the cases, a deviation of the chromaticity coordinate of the emitted light by each of the lamps from the blackbody locus in a CIE 1960 u,v chromaticity diagram was calculated (a deviation from the blackbody locus: hereinafter referred to as 'DUV'). On the basis of these results, the $ScI_3$ weight ratio and the lamp power per unit distance between the electrodes (lamp power/distance between electrodes: hereinafter referred to as 'unit power') were plotted in a diagram that has a horizontal axis for the $ScI_3$ weight ratio and a vertical axis for the unit power. The results are shown in FIG. 5. In FIG. 5, each plot shows a condition in an actual light emission, and a DUV under each of the conditions is attached to each plot. Then, the three parameters, the $ScI_3$ weight ratio, the unit power, and the DUV were approximated using a least-squares method with a quadratic. As a result of this, it was found that a DUV corresponding to a condition of light emission can be represented by the following equation.

$$D=-0.066+0.05A+0.008B+0.007A^2-0.0009AB-0.0003B^2,$$

where A is the $ScI_3$ weight ratio ($ScI_3/(ScI_3+NaI)$), B is the unit power (lamp power/distance between electrodes) (W/mm), and C is the DUV.

Figure 6:
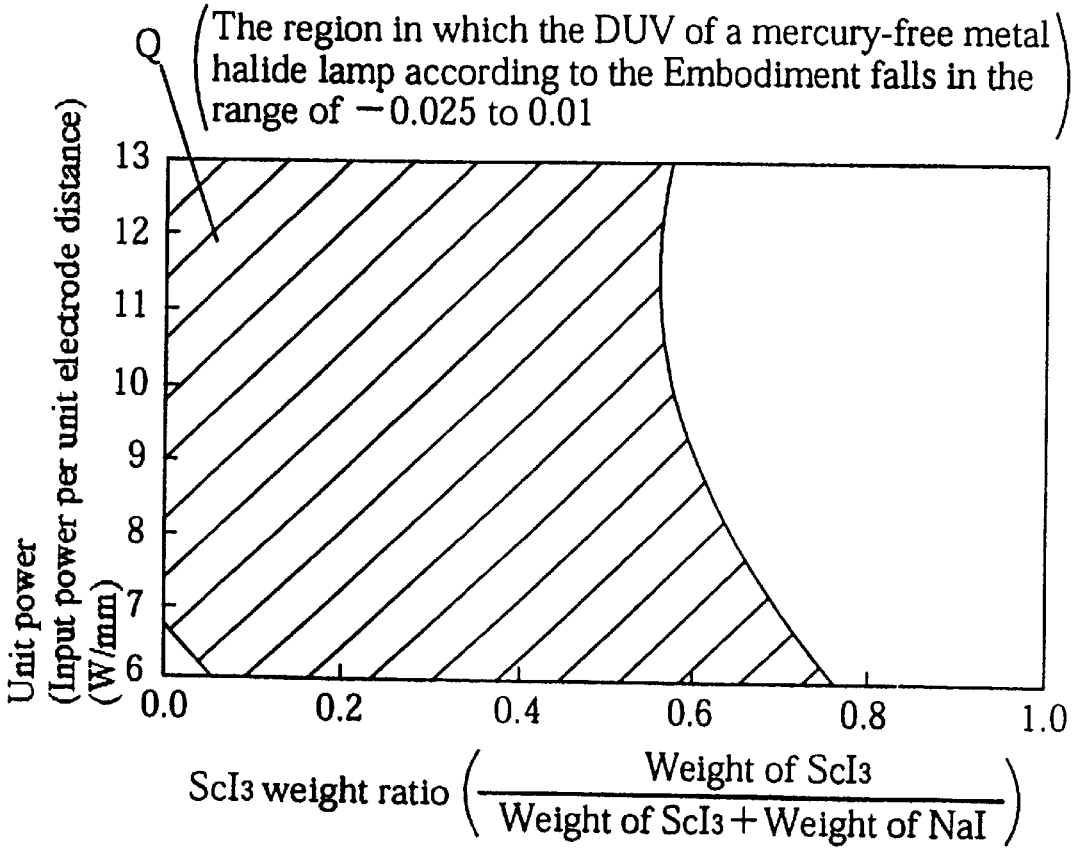
FIG. 6 is a diagram showing a region in which a DUV of a chromaticity coordinate of an emitted light of a mercury-free metal halide lamp according to Embodiment 3 is in the range of −0.025 to 0.01.

In view of the above, the conditions of light emission that result in certain predetermined values with the intervals of 0.005 were calculated, and contour lines of DUV were drawn in FIG. 5 by joining the coordinates of the above conditions of light emission with a curve. Referring now to FIG. 6, a region Q shown by slanted lines is the region in which the DUV of the lamps falls in the range of −0.025 to 0.01. This region Q equals to the range of the DUV of the white light source that is defined by the standard of Gas-discharge light sources for motor vehicles headlamps (JEL 215) by the Japan Electrical Lamp Manufacturers Association. Therefore, it is made possible to obtain a lamp that satisfies the condition of the DUV required for white light sources for motor vehicle headlights and is usable for a white light source for motor vehicle headlights, by setting the conditions of light emission to satisfy the following equation, $$-0.025 \leqq D-0.066+0.05A+0.008B+0.007A^2-0.0009AB-0.0003B^2 \leqq 0.01$$

Now, the description explains the luminous flux of the lamp according to the above-described construction.

Figure 7:
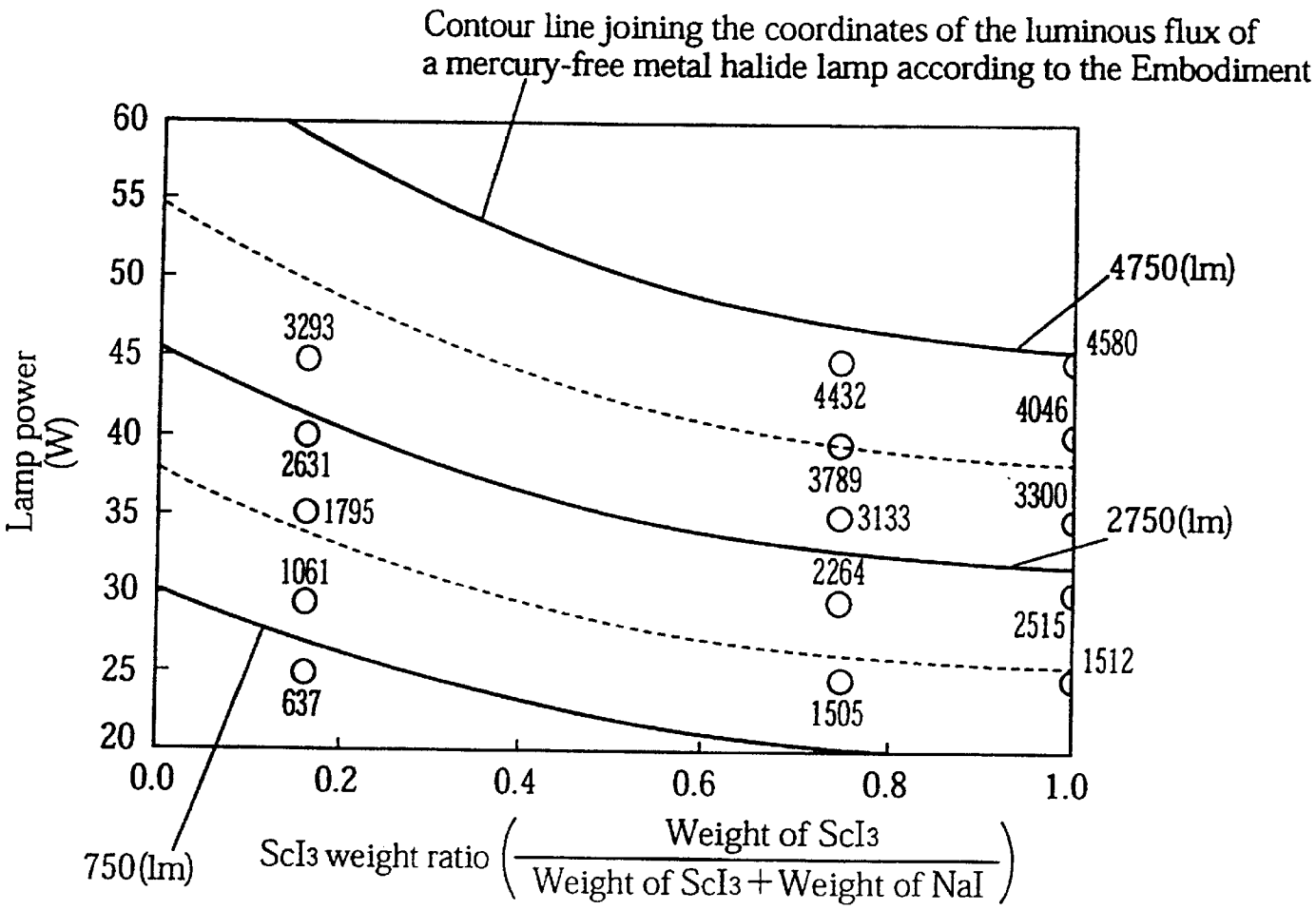
FIG. 7 is a diagram showing a relationship between a $ScI_3$ weight ratio and a lamp power and a luminous flux of a mercury-free metal halide lamp according to Embodiment 3.

The lamps according to Embodiment 3, which are made to have various $ScI_3$ weight ratios, were operated in the same manner as in the above-described measurement of color characteristics, i.e., with lamp powers of 20 W to 55 W, and the luminous flux in each case was measured. On the basis of these results, the $ScI_3$ weight ratio and the lamp power were plotted in a diagram having a horizontal axis for the $ScI_3$ weight ratio and a vertical axis for lamp power. The results are shown in FIG. 7. In FIG. 7, each plot shows a condition in an actual light emission, and the luminous flux under each of the conditions is attached to each plot. Then, the three parameters, the $ScI_3$ weight ratio, the lamp power, and the DUV were approximated using a least-squares method with a quadratic. Consequently, it was found that a luminous flux corresponding to a condition of light emission can be represented by the following equation.

$$E=-4054+2759A+182C-1628A^2+18\,AC-0.7C^2,$$

where A is the $ScI_3$ weight ratio ($ScI_3/(ScI_3+NaI)$),

C is the lamp power (W), and

E is the luminous flux (lm).

Figure 8:
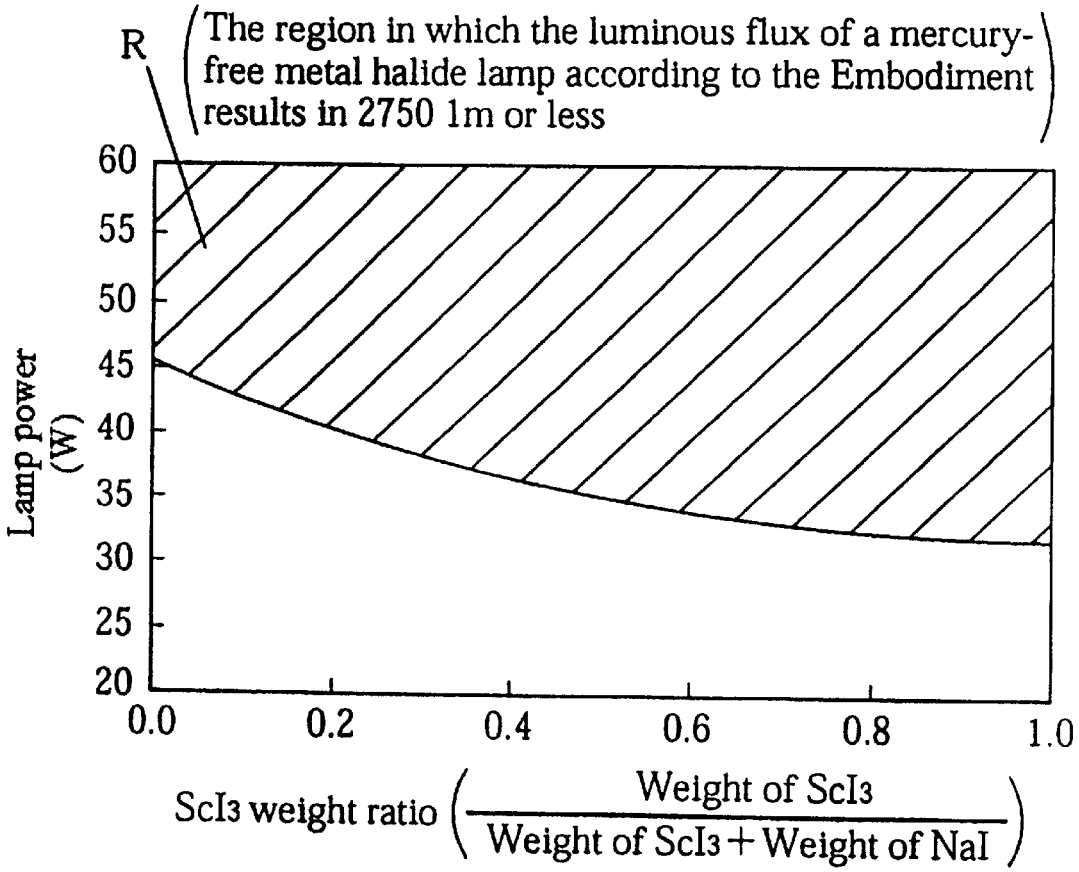
FIG. 8 is a diagram showing a region in which a luminous flux of an emitted light of a mercury-free metal halide lamp according to Embodiment 3 is 2750 lm or more.

In view of the above, the conditions of light emission that result in certain predetermined luminous flux values with the intervals of 1000 lm were calculated, and contour lines of the luminous flux were drawn in FIG. 7 by joining the coordinates of the above conditions of light emission with a curve. Referring now to FIG. 8, a region R shown by slanted lines is the region in which the luminous flux of the lamps results in 2750 lm or higher. This region R equals to the range of the luminous flux of the white light source that is defined by the standard of HID light sources for motor vehicle headlights (JEL 215) by the Japan Electrical Lamp Manufacturers Association. It is understood that the lamp with a larger luminous flux than prior art lamps can be obtained by making the condition of light emission of the lamp to satisfy the following equation, $$1100 \leqq -4054+2759A+182C-1628A^2+18AC-0.7C^2.$$

More preferably, by setting the value of the right side of the equation to be 2750 or higher, it is made possible to obtain a lamp that has a luminous flux equal to or higher than the luminous flux required for the conventional metal halide lamps for motor vehicle headlights, and thus is usable for a white light source for motor vehicle headlights.

Embodiment 4

Now, there is described another example of a mercury-free metal halide lamp according to the present invention, which can increase the operating voltage.

The lamp according to this embodiment has the same shape and dimensions as the lamp of Embodiment 1 except that the distance between the electrodes is approximately 4.2 mm.

The contents in the fill material of this lamp is as follows:

InI (indium iodide): approx. 0.2 mg (8.0 mg/cc)

TlI (thallium iodide): approx. 0.2 mg (8.0 mg/cc)

NaI (sodium iodide): approx. 0.2 mg (8.0 mg/cc)

Xe (xenon): approx. 700 kPa (at room temperature)

(The values in brackets above indicate the amount to be enclosed per unit arc tube inner volume)

Figure 9:
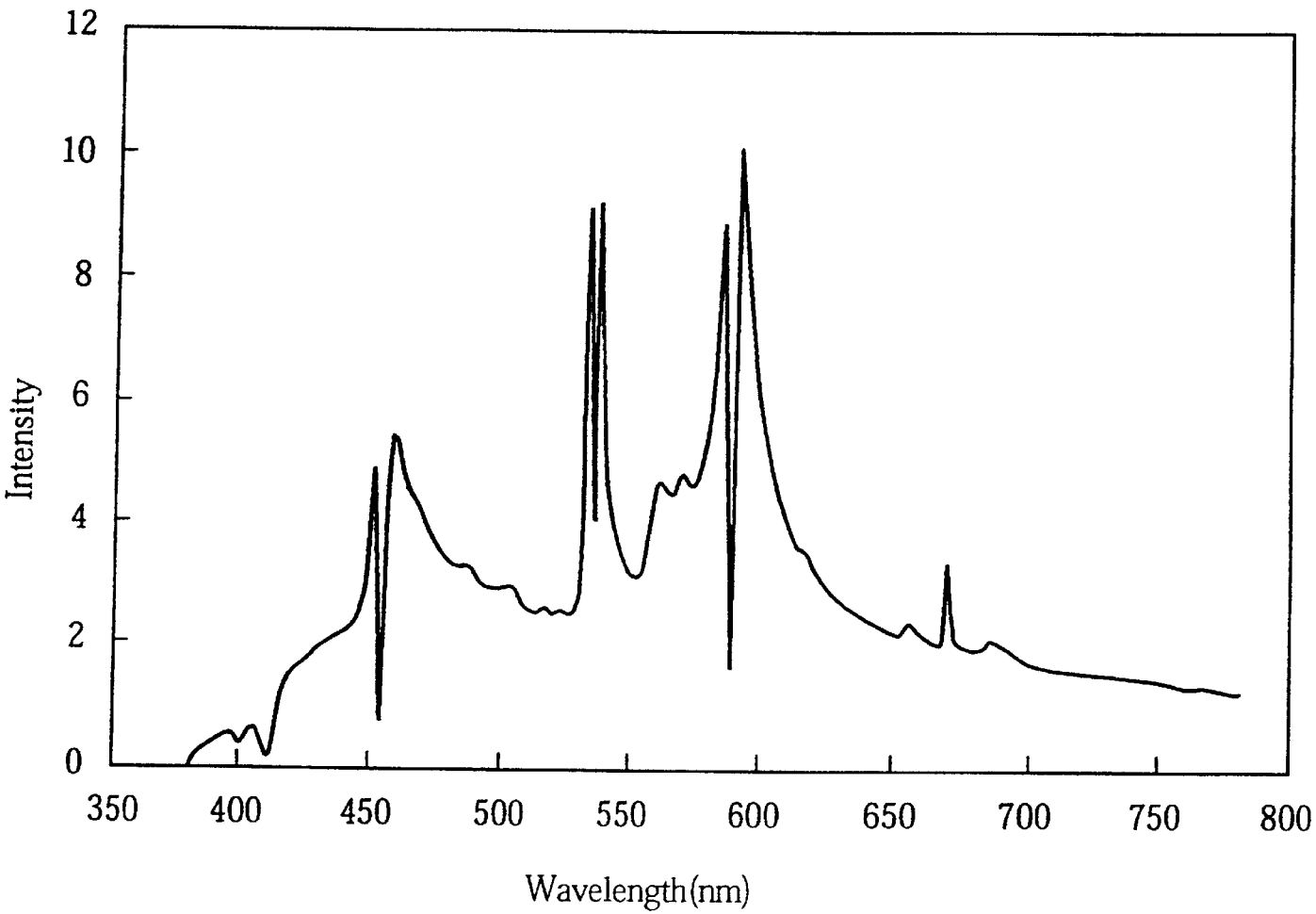
FIG. 9 is a diagram showing a spectral distribution of a mercury-free metal halide lamp according to Embodiment 4.

When the lamp according to the above construction was operated with a lamp power of 45 W, the operating voltage resulted in 55 V. Owing to such a high operating voltage, this lamp maintained a bright light emission for over several hundred hours without causing blacking of the arc tube. The spectral distribution in this case was, as shown in FIG. 9, completely different from that of prior art lamps.

The reason why such a high operating voltage can be obtained despite the fact that no mercury is contained as in prior art lamps is that a large amount of halides are enclosed in the lamp. Specifically, in order to obtain a high operating voltage as described above, halides of In, Tl, and Na should be added so that, in a spectral distribution, (a) absorption spectra at a wave length of approximately 410.1 nm and 451.1 nm by In (indium), (b) an absorption spectrum at a wave length of approximately 535.0 nm by Tl (thallium), and (c) absorption spectra at a wave length of approximately 589.0 nm and 589.6 nm by Na (sodium)

are observed.

More specifically, per unit internal volume of arc tube, (a) approx. 0.2 mg/cc or more of halide of In, (b) approx. 1 mg/cc or more of halide of Tl, and (c) approx. 2 mg/cc or more of halide of Na should be added in order for these halides to evaporate in a large amount.

Now, the description is concerned with color characteristics of the lamp according to Embodiment 4.

Figure 10:
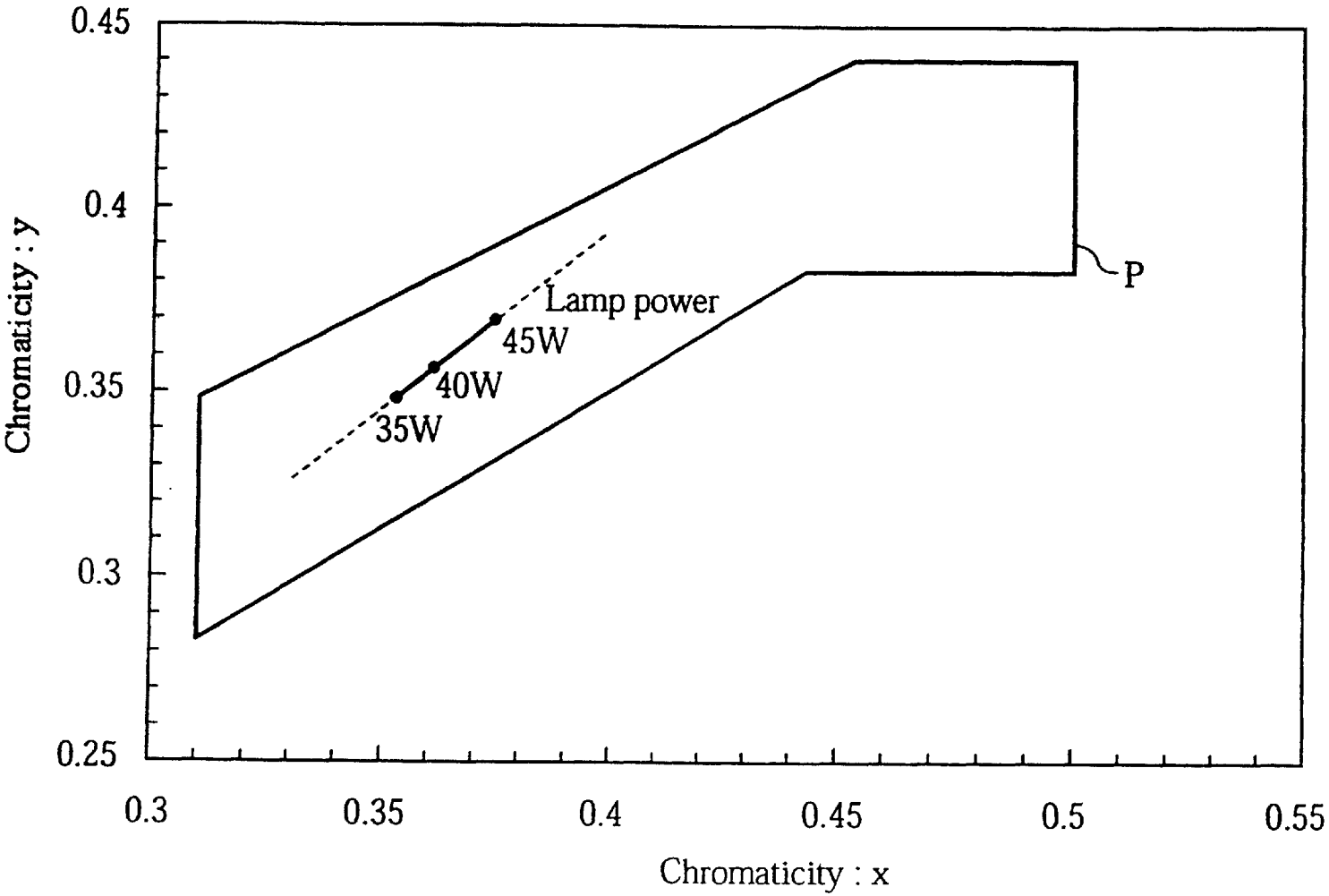
FIG. 10 is a diagram showing a chromaticity coordinate of an emitted light of a mercury-free metal halide lamp according to Embodiment 4.

FIG. 10 shows chromaticity coordinates of the emitted light of the lamp according to this embodiment in the case where the lamp is operated with a lamp power of 35 to 45 W, the chromaticity coordinates being plotted in a CIE1931 x,y chromaticity diagram as in Embodiment 1. As seen from FIG. 10, the lamp according to this embodiment satisfies the chromaticity requirement of the white light source set forth in the standard of Gas-discharge Light Sources for Motor Vehicle Headlamps (JEL 215) by the Japan Electrical Lamp Manufacturers Association.

In order to satisfy the chromaticity according to the above-mentioned standard, the amounts of halides of In, Tl, and Na to be added per unit internal volume of arc tube should be:

(a) approx. 4 to 12 mg/cc of halide of In, (b) approx. 2 to 16 mg/cc of halide of Tl, and (c) approx. 4 to 12 mg/cc of halide of Na.

According to this construction, it will be possible to satisfy the above-mentioned standard even with a lamp power of approximately 10 to 60 W.

Now, the description is made concerning a luminous efficacy of the amp according to Embodiment 4.

Figure 11:
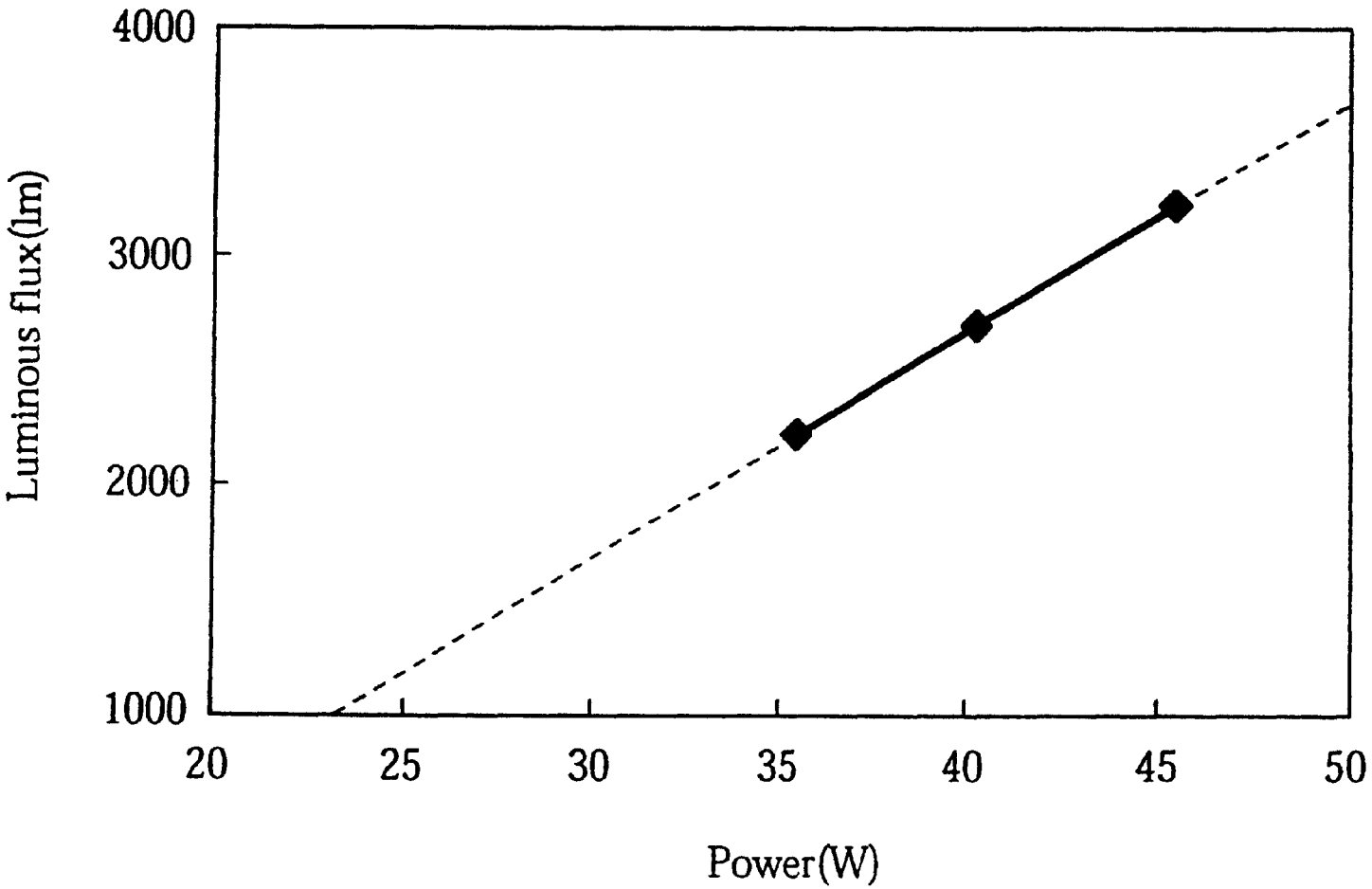
FIG. 11 is a diagram showing a relationship between a lamp power and a luminous flux of an emitted light of a mercury-free metal halide lamp according to Embodiment 3.
Figure 12:
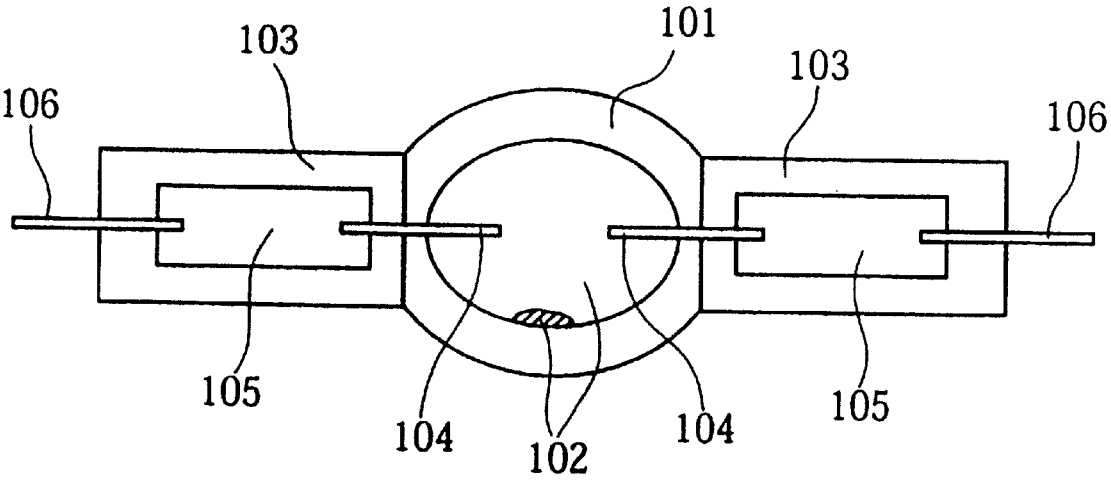
FIG. 12 is a cross-sectional view showing a construction of a prior art metal halide lamp.
Figure 13:
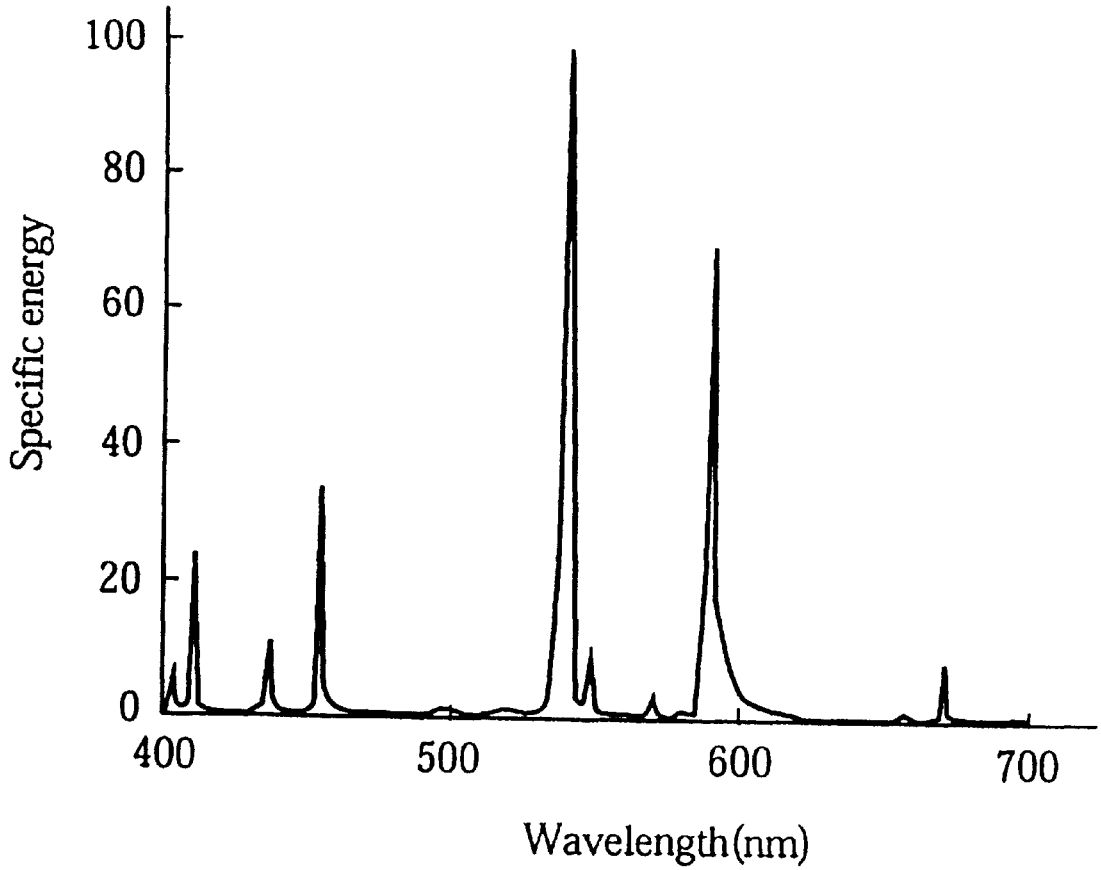
FIG. 13 is a diagram showing a spectral distribution of a prior art metal halide lamp.

The observed luminous efficacy of the lamp was approximately 70 lm/W; that is, the whole luminous flux at a lamp power of 45 W was 3150 m. By contrast, halogen lamps conventionally used for motor vehicle headlights show a whole luminous flux of approximately 1100 lm at a rated power of 55 W. As seen from these results, the lamp according to this embodiment achieves a larger luminous flux than the above-mentioned conventional halogen lamps even at a rated power of 25 W, as seen in FIG. 11. Furthermore, if a rated power is made to be larger than 25 W, even larger luminous flux can be obtained, and thereby it is made possible to obtain a further brighter motor vehicle headlight. In addition, if the rated power is made to be, for example, in the range of approximately 25 to 55 W, it is made possible to produce a lamp most suitably used for a light source for motor vehicle headlights, in which the chromaticity as shown in FIG. 10, is also taken into account. Note that in the case where such a lamp is used for motor vehicle headlights, it is preferable that the rated power be made to be 55 W or lower, so that it does not exceed a consumption power of conventional halogen lamps.

In the above Embodiment 1 through 3, there have been shown examples in which $YI_3$ or InI is contained in the fill material. However, the present invention is not limited thereto, and it is understood the effect of increase in operating voltage can be obtained by employing metal or halide of metal having an ionization potential as a simple substance being within the range of 5 to 10 eV and a vapor pressure at a temperature of lamp operation being at least $10^{-5}$. More specifically, examples of the materials that may be used for the contents of the fill material include $YBr_3$ (yttrium bromide), $InI_3$ (indium triiodide), $SbI_3$ (antimony iodide), InBr (Indium bromide), TlI (thallium iodide), and so forth. A combination of these substances in plurality may also be usable.

In addition, in each of the above embodiments, among halides, I (iodine) is employed as a halogen. However, the same effects are obtained in the cases of other halogens such as Br (bromine) and Cl (chlorine), and the combinations thereof, for example, the combination of $YI_3$ and $YBr_3$, or the combination of NaI and TlI and InBr.

Furthermore, in the above Embodiments, to facilitate a starting of the lamp, Xe of 7 atm or 700 kPa at room temperature is filled. However, types of rare gases and pressures are not limited thereto. Xe is suitable in that a high-pressure filling is easily carried out since the boiling point of Xe is the highest among rare gases except Rn (radon), and Xe is also suitable in consideration of the use for motor vehicle headlights. However, the present invention is not limited thereto, and the same effect of increasing operating voltage can also be obtained by employing other rare gases such as Ar (argon) and the like. Further, the pressure in filling is not limited to the above pressure. However, taking into consideration a starting characteristic of the luminous flux when starting a lamp, a pressure of approximately 1 atm or higher is preferable, and taking into consideration a breaking strength of the lamp, a pressure of 25 atm or lower is preferable.

In addition, in the above description, although the amounts of the contents in the fill material, their enclosing ratios, and the lamp powers are so determined that the chromaticity and luminous flux required for motor vehicle headlights can be obtained, the present invention is not limited thereto. When complying with the above conditions, a high quality of white color chromaticity and a large luminous flux is particularly notable, but even the adding amounts and ratios, and lamp powers do not fall into the above range, a desirable quality of white color and relatively large luminous flux can still be attained. Moreover, the effect of increasing operating voltages is obtained, and therefore, a lamp according to the present invention is also usable for lamps for uses other than motor vehicle headlights.

Furthermore, it is to be understood that the shapes and sizes of a lamp are also not limited to the ones specified above.

Industrial Applicability

As has been described above, a mercury-free metal halide lamp according to the present invention comprises an arc tube that encloses a rare gas, Sc or halide of Sc, Na or halide of Na, and a metal or halide of metal having an ionization potential as a simple substance of 5 to 10 eV and having a vapor pressure of at least $10^{-5}$ atm at an operating temperature of the lamp. Accordingly, it is possible to make an operating voltage of the lamp to be high, and to reduce an electric current in the lamp, and therefore, heat load to the electrodes is reduced. As a result, a blackening of the arc tube caused by sputtered matter of the electrodes is suppressed, and a long lamp life is achieved.

In addition, a mercury-free metal halide lamp comprises an arc tube that encloses a rare gas, In or halide of In, Tl or halide of Tl, Na or halide of Na, and the amounts of these elements are made to be such amounts that, in each of the spectral distributions, an absorption spectrum is observed at approximately 410 nm and 451 nm, approximately 535 nm, or approximately 589 nm, respectively. As a result, an operating voltage can be increased and a long lamp life is achieved.

Furthermore, the above-mentioned rare gas may be Xe, and by enclosing Xe with a fill pressure of from 1 atm to 25 atm at room temperature, the burst of the arc tube and the leak of the fill materials are prevented.

Hence, the present invention is useful in such fields as general luminaries, motor vehicle headlights, and the like.

What is claimed is:

1. A mercury-free metal halide lamp comprising an arc tube which encloses at least:

a rare gas, at least one of Sc (scandium) and halide of Sc, at least one of Na (sodium) and halide of Na, and at least one of metal and halide of the metal, said metal having an ionization potential as a simple substance of 5 to 10 eV, and said one of metal or halide of the metal having a vapor pressure of at least $10^{-5}$ atm at an operating temperature of said lamp.

2. A mercury-free metal halide lamp as set forth in claim 1, in which said metal or said halide of the metal is Y (yttrium) or halide of yttrium.

3. A mercury-free metal halide lamp as set forth in claim 1, in which said metal or said halide of the metal is In (indium) or halide of indium.

4. A mercury-free metal halide lamp as set forth in claim 1, in which the amount of Sc or halide of Sc, the amount of Na or halide of Na, the amount of said metal or halide of the metal, and a rated power of said lamp are determined so that, in a CIE1931 x,y chromaticity diagram, a chromaticity coordinate of an emitted light of said lamp satisfies the following equations:

$$x \geqq 0.310,$$

$$x \leqq 0.500,$$

$$y \leqq 0.150+0.640x,$$

$$y \leqq 0.440,$$

$y \geqq 0.050+0.750x$, *and*

$y \geqq 0.382$ (in the case where $x \geqq 0.44$).

5. A mercury-free metal halide lamp as set forth in claim 4, in which:

said halide of the metal is $YI_3$, the amount of said $YI_3$ is within the range of 0.8 mg/cc to 12 mg/cc per unit internal volume of the arc tube, and a rated power of said lamp is set to be within the range of 25 W to 55 W.

6. A mercury-free metal halide lamp as set forth in claim 1, in which the amount of Sc or halide of Sc, the amount of Na or halide of Na, the amount of said metal or halide of the metal, and a rated power of said lamp are determined so that, in a CIE 1931 x,y chromaticity diagram, a chromaticity deviation of a chromaticity coordinate from a blackbody locus is within the range of −0.025 to 0.01.

7. A mercury-free metal halide lamp as set forth in claim 6, in which:

said halide of Sc is $ScI_3$, said halide of Na is NaI, and the amount of Sc or halide of Sc, the amount of Na or halide of Na, the amount of said metal or halide of the metal, and a rated power of said lamp are determined so that the following equation is satisfied:

$$-0.025 \leqq D=-0.066+0.05A+0.008B+0.007A^2-0.0009AB-0.0003B^2 \leqq 0.01$$

where A=the weight of $ScI_3$/(the weight of $ScI_3$+the weight of NaI) and B=rated power/distance between electrodes (W/mm).

8. A mercury-free metal halide lamp as set forth in claim 1, in which the amount of Sc or halide of Sc, the amount of Na or halide of Na, the amount of said metal or halide of the metal, and a rated power of said lamp are determined so that a luminous flux of an emitted light of said lamp results in at least approximately 1100 lm.

9. A mercury-free metal halide lamp as set forth in claim 8, in which the amount of Sc or halide of Sc, the amount of Na or halide of Na, the amount of said metal or halide of the metal, and a rated power of said lamp are determined so that a luminous flux of an emitted light of said lamp results in at least approximately 2750 lm.

10. A mercury-free metal halide lamp as set forth in claim 9, in which:

said halide of Sc is $ScI_3$, said halide of Na is NaI, and the amount of Sc or halide of Sc, the amount of Na or halide of Na, the amount of said metal or halide of the metal, and a rated power of said lamp are determined so that the following equation is satisfied:

$$1100 \leqq -4054+2759A+182C-1628A^2+18AC-0.7C^2$$

where A=the weight of $ScI_3$/(the weight of $ScI_3$+the weight of NaI) and C=lamp power (W).

11. A mercury-free metal halide lamp comprising an arc tube which encloses at least:

a rare gas, at least one of In (indium) and halide of In, at least one of Tl (thallium) and halide of Tl, and at least one of Na (Sodium) and halide of Na, said lamp in which:

the amount of said In or halide of In is such an amount that an absorption spectrum is observed at approximately 410 nm and 451 nm in a spectral distribution, the amount of said Tl or halide of Tl is such an amount that an absorption spectrum is observed at approximately 535 nm in a spectral distribution, and the amount of said Na or halide of Na is such an amount that an absorption spectrum is observed at approximately 589 nm in a spectral distribution.

12. A mercury-free metal halide lamp as set forth in claim 11, in which the amount of said In or halide of In is within the range of 4 to 12 mg/cc per unit internal volume of the arc tube.

13. A mercury-free metal halide lamp as set forth in claim 11, in which the amount of said Tl or halide of Tl is within the range of 2 to 16 mg/cc per unit internal volume of the arc tube.

14. A mercury-free metal halide lamp as set forth in claim 11, in which the amount of said Na or halide of Na is within the range of 4 to 12 mg/cc per unit internal volume of the arc tube.

15. A mercury-free metal halide lamp as set forth in claim 11, in which:

the amount of said In or halide of In is within the range of 4 to 12 mg/cc per unit internal volume of the arc tube, and the amount of said Tl or halide of Tl is within the range of 2 to 16 mg/cc per unit internal volume of the arc tube.

16. A mercury-free metal halide lamp as set forth in claim 11, in which:

the amount of said In or halide of In is within the range of 4 to 12 mg/cc per unit internal volume of the arc tube, and the amount of said Na and halide of Na is within the range of 4 to 12 mg/cc per unit internal volume of the arc tube.

17. A mercury-free metal halide lamp as set forth in claim 11, in which:

the amount of said Tl or halide of Tl is within the range of 2 to 16 mg/cc per unit internal volume of the arc tube, and the amount of said Na or halide of Na is within the range of 4 to 12 mg/cc per unit internal volume of the arc tube.

18. A mercury-free metal halide lamp as set forth in claim 11, in which:

the amount of said In or halide of In is within the range of 4 to 12 mg/cc per unit internal volume of the arc tube, the amount of said Tl or halide of Tl is within the range of 2 to 16 mg/cc per unit internal volume of the arc tube, and the amount of said Na or halide of Na is within the range of 4 to 12 mg/cc per unit internal volume of the arc tube.

19. A mercury-free metal halide lamp as set forth in claim 11, in which the amount of In or halide of In, the amount of Tl or halide of Tl, the amount of said Na or halide of Na, and a rated power of said lamp are determined so that, in a CIE1931 x,y chromaticity diagram, a chromaticity coordinate of an emitted light of said lamp satisfies the following equations:

$x \geqq 0.310$, $x \leqq 0.500$, $y \leqq 0.150+0.640x$, $y \leqq 0.440$, $y \geqq 0.050+0.750x$, and $y \geqq 0.382$ (in the case where $x \geqq 0.44$).

20. A mercury-free metal halide lamp as set forth in claim 11, in which a rated power of said lamp is in the range of 25 W to 55 W.

21. A mercury-free metal halide lamp as set forth in claim 11, in which said rare gas comprises at least Xe (xenon), and a fill pressure of said Xe is in the range of 1 atm to 25 atm at room temperature.

22. A mercury-free metal halide lamp as set forth in claim 1, in which said rare gas comprises at least Xe (xenon), and an enclosed pressure of said Xe is in the range of 1 atm to 25 atm at room temperature.

* * * * *